US005156075A

United States Patent [19]

Campbell, Jr. et al.

[11] Patent Number: 5,156,075

[45] Date of Patent: Oct. 20, 1992

[54] CHIP REMOVAL APPARATUS FOR ROTARY CUTTERS OF WEB PRINTING PRESSES

[76] Inventors: Gaines P. Campbell, Jr., 227 Fleetwood Dr., Lookout Mountain, Tenn. 37350; Blaine C. Stambaugh, 210 Sylvan Dr., Signal Mountain, Tenn. 37377

[21] Appl. No.: 684,030

[22] Filed: Apr. 11, 1991

[51] Int. Cl.[5] ..... B26D 1/40

[52] U.S. Cl. ..... 83/100; 83/150; 83/331; 83/343

[58] Field of Search ..... 83/98, 99, 100, 906, 83/331, 343, 150; 241/60

[56] References Cited

U.S. PATENT DOCUMENTS

| | | | |
|---|---|---|---|
| 2,381,507 | 8/1945 | Miller | 241/60 X |
| 3,322,037 | 5/1967 | Cavaghero | 83/100 X |
| 3,548,698 | 10/1970 | Hornung | 83/100 |
| 3,763,748 | 10/1973 | Gallagher, Jr. | 83/100 X |
| 3,893,359 | 7/1975 | Gregoire | 83/154 |
| 4,480,516 | 11/1984 | Leroy | 83/98 |
| 5,024,128 | 6/1991 | Campbell, Jr. | 83/150 X |

*Primary Examiner*—Frank T. Yost
*Assistant Examiner*—Kenneth E. Peterson
*Attorney, Agent, or Firm*—Phillips & Beumer

[57] ABSTRACT

Apparatus for removing and disposing of scrap paper chips impaled on a roller rotating away from the cutting region of a rotary cutter has a pneumatic baffle plate located a distance of ⅜ to 1½ inches away from the roller, defining a narrow flow channel through which an air stream is sucked by a centrifugal fan. The baffle is spaced apart from the roller a distance such as to impart a high velocity to the air stream due to aerodynamic effects, causing chips to be forcibly removed from the roller when the chips reach an area above the flow channel. The baffle along with a chute that supports it and duct leading to the fan provide an enclosed channel for movement of the chips. The baffle edge adjacent the roller is provided with a curved surface to provide smooth flow of the air stream. The output of the fan has an air duct connected for conveying the chips to disposal.

12 Claims, 2 Drawing Sheets

CHIP REMOVAL APPARATUS FOR ROTARY CUTTERS OF WEB PRINTING PRESSES

FIELD OF THE INVENTION

This invention relates generally to web printing press equipment and more particularly to devices for removing scrap material, or "chips," produced in operation of rotary cutters, or "sheeters," of such equipment.

BACKGROUND OF THE INVENTION

Web printing presses at their output end are normally coupled to a "sheeter" device for cutting a printed product from a continuous web into brochures, pamphlets, etc., of a desired length (units). The sheeter may comprise one or more sets of cooperating knife and anvil rollers between which the web is fed. Knives are disposed longitudinally on one or both of the rollers, extending radially outward from the circumference of the roller and arranged to come into slight contact, or "kiss," with the opposing roller. The knives are spaced apart around the circumference of the roller in a manner such as to make cuts at desired locations with scrap pieces or "chips" being transversely cut between the end of one unit and the beginning of the next unit. These transversely cut chips must be removed from the cutting area and disposed of as waste. Removal of chips from such devices has been carried out by providing pins protruding from a roller of a rotary cutter, or sheeter, the pins being arranged to impale the chips as they are being cut. As the roller rotates, it carries the pins with impaled chips so they can be released and conveyed to a container for disposal.

Various arrangements for removing pin-impaled chips from cutter rollers are disclosed in prior art patents, exemplified by U.S. Pat. No. 4,846,030, issued Jul. 11, 1989, to McMahon et al., which discloses apparatus wherein impaled chips are removed in an arcuate path, scraped off onto a moving belt, and conveyed to a receptacle. U.S. Pat. No. 3,893,359, issued Jul. 8, 1975, to Gregoire, provides for removing impaled chips from a roller by use of spaced-apart fingers adjacent to the back side of the roller, the fingers stripping the chips from the pins as they pass between the fingers. Chip removal devices that rely on mechanical parts such as fingers, combs, or the like for physical removal present disadvantages in that precise adjustment and synchronization are required for their operation, and they tend to be expensive to manufacture and install. They also may interfere with access to other parts of the overall system.

Air jets or high pressure gas streams for removal of scrap cut from webs of material are disclosed in several prior patents. U.S. Pat. No. 3,252,366, issued May 24, 1966, to Karr, shows air jets for directing high velocity air to the cutting area of a slitter device for trimming a strip from the edge of a traveling web. U.S. Pat. No. 3,670,612, issued Jun. 20, 1972, to Johnson et al., discloses use of air under pressure to blow away scrap pieces generated in cutting cards from a web. While these and other patents show various ways of applying air streams for the purpose of removing scrap material generated by a rotary cutter, none of them discloses or suggests the present invention which includes using a flow channel spaced along the length of the chip-carrying roller and having defined features by means of which a high velocity is imparted to an air stream being drawn through the flow channel.

SUMMARY OF THE INVENTION

The present invention is directed to an apparatus for removing and disposing of scrap chips impaled on or otherwise carried on a roller rotating away from the cutting region of a rotary cutter. In particular, the chips may be produced as scrap by transverse cutting of printed paper units from a continuous web after the web has passed through a printing press.

The apparatus comprises a pneumatic baffle which has a curved edge, which may be circular, elliptical, or parabolic in shape. This edge is positioned parallel to and spaced apart from the chip carrying roller a distance such as ¾ inch. The pneumatic baffle is connected to other elements of a chute so that air may be drawn by means such as a centrifugal fan through the flow channel created between the roller and the pneumatic baffle. As air is drawn toward the flow channel, it begins to accelerate (gains velocity). This increase in velocity causes a peak velocity and minimum pressure (less than ambient, sometimes called vacuum or suction) at the minimum flow point. The operation of the paper chip removal system is based on this simple principle, which is the creation of a low pressure region by forcing air through narrow openings, producing the force which strips the chip from the small metal pins on the roller. As soon as the chip is removed, it is immediately accelerated into the flow channel and sucked through the fan to a disposal bin. A key point which aids in the efficient operation of the chip removal is the use of gentle, curved surfaces at the entrance of the flow channel. This feature allows the air to accelerate smoothly and stay attached to the surfaces (much like the air accelerating over the upper surface of a low speed aircraft wing). This smooth acceleration avoids separation regions (pockets of "dead" air) where recirculation can trap the chip, now allowing it to be sucked into the fan duct.

Apparatus embodying the invention is more effective and forceful than mechanical stripping devices, as well as being more economical, easier to install, and less intrusive to access to other components of a web printing press. Substantial improvement is also shown over prior approaches based on blowing of air jets or pressurized air onto scrap pieces to remove them from the cutting area.

It is, therefore, an object of this invention to provide an apparatus for removing paper chips from impalement on a roller that does not require stripping by mechanical components.

Another object is to provide an air stream chip removal apparatus that forcefully pulls the chips away from pins on the roller.

Yet another object is to provide a chip removal apparatus that readily conveys removed chips to a container for disposal.

Other objects and advantages of the invention will be apparent from the following detailed description of appended claims.

DESCRIPTION OF THE PREFERRED EMBODIMENT

Figure 1:
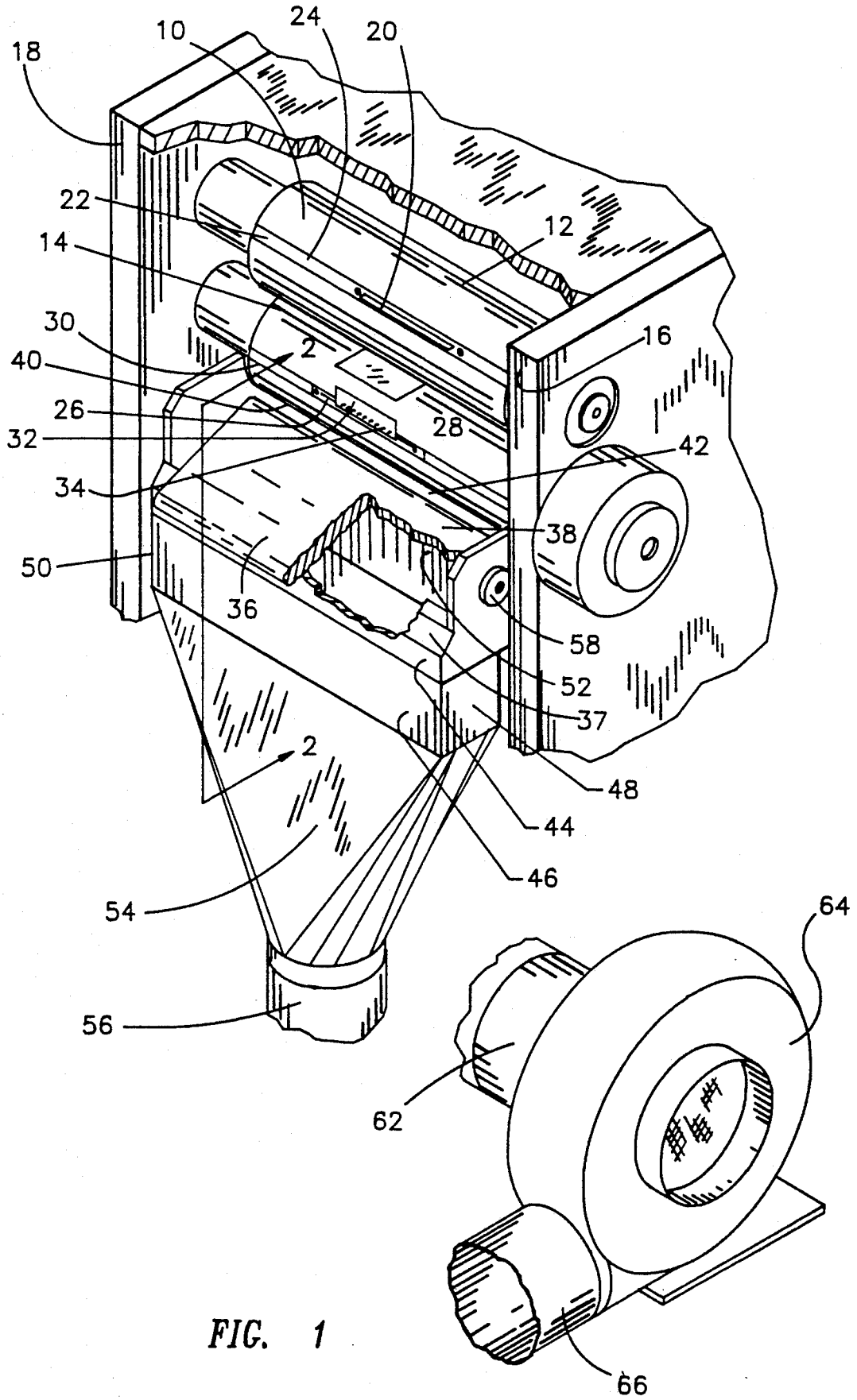
FIG. 1 is a perspective view of portions of a web printing press showing cooperative cutting rollers and chip removal apparatus of this invention in place.

Referring to FIG. 1 of the drawings, there is shown a rotary cutter 10 which is the output element of a web printing press. The cutter has cooperating generally cylindrical rollers, a knife roller 12 being disposed over an anvil/knife roller 14. The rollers are mounted for rotation on spaced-apart vertical end walls 16, 18.

Roller 12 is provided with elongated knives 20 mounted in blocks 22 which in turn are disposed in slots 24 and extend parallel to one another along the length of the roller. The knives protrude outward a distance such as 0.45 inch from the knife roller surface so as to make slight contact with the anvil roller. Anvil roller 14 may also have knives 26 mounted in blocks 28 disposed in slots 30 of the roller. Impalement pins 32 are also mounted in the block spaced apart from knives 26. In operation of the cutter, an incoming web (not shown) from a web printing press is fed between rollers of the rotary cutter, and transverse cuts defining ends of the product units are made by knives 20 and 26 at locations such that a chip 34 between units is produced. Simultaneous with making the cuts, pins 32 are projected into the chips, impaling them for being conveyed by the anvil roller away from the cutting area. Rollers 12 and 14 rotate in opposite directions, roller 12 moving clockwise when viewed from wall 16 so as to carry the knives upward away from the cutting area, and roller 14 moving counterclockwise, carrying the knives and pins with impaled chips downward and away from the cutting area. The chips are thus brought to a location above the chip removal apparatus of the present invention. Units of finished product are grasped by nip rollers (not shown) immediately before cuts are made and are carried by these rollers for final handling by conventional devices.

Chip removal according to the present invention is carried out by providing a pneumatic baffle 36 in spaced-apart and parallel relation to the surface of roller 14, edge 38 of the baffle and roller surface 40 defining an elongated flow channel 42 through which an air stream is drawn as discussed below. Baffle 36 is mounted on cross member 37 at the top of outer wall 44 of a chute 46 defined by the outer wall, end plates 48, 50 and inner wall 52 and tapered sections 54 communicating the chute with circular duct 56. Inner edge 38 of baffle 36 has gentle curved surface which may be circular, elliptical, or parabolic in cross section so as to provide the desired flow characteristics in the flow channel. Spacing of the baffle edge from the roller surface may be adjusted as desired by loosening knob 58 which engages the end of the baffle, allowing movement toward and away from the roller. As shown in FIG. 1, the baffle may be inclined downward along its length at an angle of approximately 45 degrees, although this angle is not critical. For chips having a size typically produced by rotary cut that is ¼ inch to 1 ¼ inches wide and 2 to 26 inches long, a spacing of the baffle edge from the roller surface of ⅜ inch to 1 ½ inches, and preferably about ¾ inch may be used, with wider spacing being used for bigger chips.

Inner wall 52 of chute 42 is preferably located with its top edge 60 spaced apart from roller surface 40 a distance such as to allow knives and pins in the roller to slightly clear the edge when rotating. Wider spacing would detract from obtaining the desired air flow pattern. End plates and tapered portions of the chute are not critical except that they are preferably arranged to allow high-velocity flow without introduction of a substantial air flow at the ends of the flow channel.

Duct 56 is connected to an air source which may be the input side 62 of a centrifugal blower 64. Upon being sucked into the blower, chips are projected outward from the blower through duct 66 and are conveyed away to a suitable hopper (not shown) for disposal.

Operation of the paper chip removal system is based on the creation of a low pressure region by forcing air through a narrow opening, producing the force which strips the chips from the small metal pins on the cutting roller. As soon as the chip is removed, it is immediately accelerated into the flow channel and sucked through the fan duct to a disposal bin. A key point which aids in the efficient operation of the tab is the use of gently curved surfaces at the entrance of the flow channel. This feature allows the air to accelerate smoothly and stay attached to the surfaces (much like the air accelerating over the upper surface of a low speed aircraft wing). This smooth acceleration avoids separation regions (pockets of "dead" air) where recirculation can trap the chip, not allowing it to be sucked into the fan duct. The removal mechanism is based on being able to create the lowest pressure possible in the flow channel at the correct point on the cutting roller, which creates the least interference with the continuous discharge of the finished product while at the same time having the gap width large enough to accomodate the chip. The peak suction pressure in the flow channel increases rapidly with a decreasing channel width so that the narrowest as possible channel is desired, which may accommodate free movement of the paper chip.

Because of the nature of the flow in the channel, the relation between the air pressure and velocity is given by the well-known Bernoulli equation:

$$p_c - p_s = \frac{\rho_s V^2}{2} \qquad \text{(equation 1)}$$

where $P_c$ is the stagnation pressure, $P_s$ is the static pressure, $\rho_s$ is the air density at the static pressure, and V is the air velocity. The stagnation pressure in the situation encountered is that pressure in the region which the air is drawn from, i.e., the ambient (atmospheric) pressure. Since the velocity is low, the difference in the air density computed at the static pressure and that computed at the ambient pressure is negligible, the ambient value is used. Rearranging equation 1, the velocity is computed as:

$$V_a = \sqrt{2(p_c - p_s)/\rho_s} \qquad \text{(equation 2)}$$

Using $\rho_s = 0.078$ lb./ft$^3$, referencing the manometer board to p, the velocity can be expressed as:

$$V_a = 20.18\sqrt{p_s} \qquad \text{(equation 3)}$$

where $p_s$ is the experimental measured pressure on the manometer expressed in inches of the oil that was used in the manometer tube.

Figure 3:
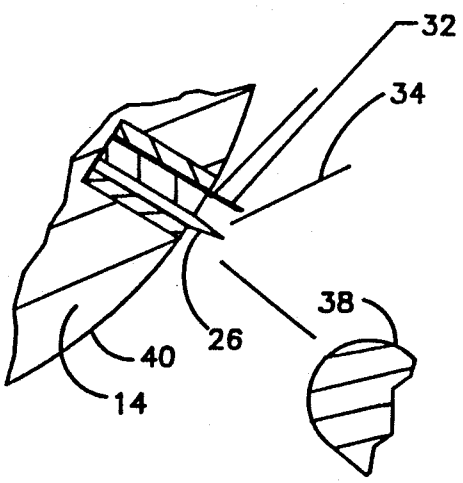
FIG. 3 is a schematic representation showing air flow effects in operation of the present invention.
Figure 2:
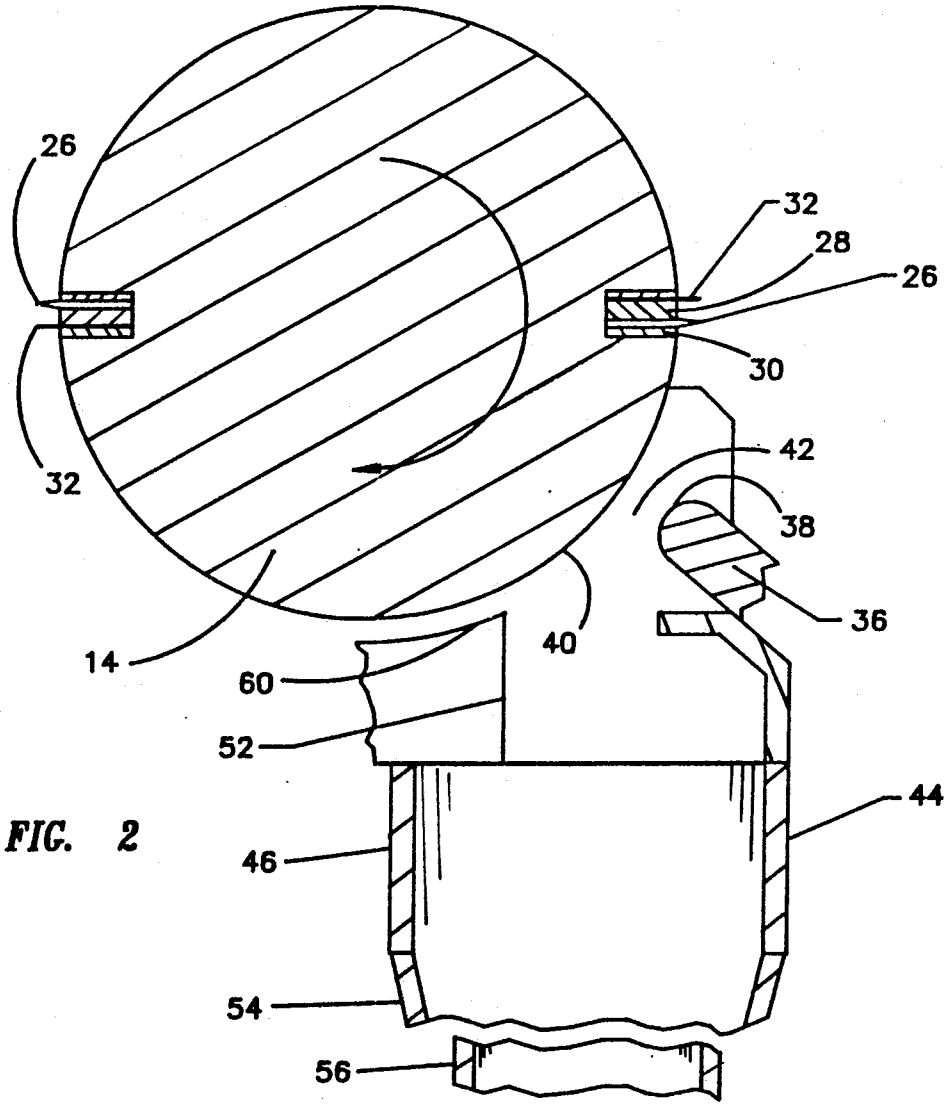
FIG. 2 is a sectional view taken through line 2—2 of FIG. 1.

Once the chip leaves the cutting roller, it is accelerated into the channel by the aerodynamic drag which creates a force on the chip. Since the chip leaves the cutting roller from the upstream side (because it is still being held at the bottom by the small metal pins), it immediately offers a flat surface perpendicular to the air stream. FIG. 3 illustrates this point. The drag on a flat plate normal to an air stream is found by applying the Bernoulli equation. The pressure on the front of chip 34 is:

$$p_s + \frac{\rho_s V_a^2}{2} \qquad \text{(equation 4)}$$

and on the back side is $$p_s$$

The force on the chip is the difference in these pressures multiplied by the surface area on which the pressure difference is being applied, hence:

Force $= F = [p_s + \rho_s V_a^2 - p_s]$ times frontal area (equation 5) Since the area of the chip is simply its length (1) times its width (w), the force on the chip is:

$$F = \frac{\rho_s V_a^2 lw}{2g_c} \qquad \text{(equation 6)}$$

expressing the air density as lb/ft$^3$, $g_c = 32.2$ ft/sec$^2$, velocity as ft/sec, 1 in ft, and w in ft yields a force on the chip in pounds (lb). As the chip accelerates, its velocity approaches that of the air stream so that the effective force is a function of the velocity difference between the chip ($V_t$) and air stream ($V_a$), hence equation 6 is modified to:

$$F = \frac{\rho_s (V_a - V_t)^2 lw}{2g_c} \qquad \text{(equation 7)}$$

To illustrate how fast the chip accelerates into the flow channel, Newton's second law of motion is used:

$$F = \text{mass} \times \text{acceleration} = ma = m dV_t/dt \qquad \text{(equation 8)}$$

where m is the mass of the chip, $V_a$ = velocity of the chip, and $dv_t/dt$ represents the rate of change of the chip's velocity with time, i.e., its acceleration. Substituting equation 7 into equation 8 and rearranging gives:

$$\frac{dV_t}{V_a - V_t} = \frac{\rho_s lw}{2g_{cm}} dt \qquad \text{(equation 9)}$$

Assuming $V_a$ to be nearly constant in the channel and letting $V_t = 0$ at time $t = 0$, integration of the above equation gives:

$$t = [2mg_c/(\rho_s lwV_a)] \times [(V_a/V_t)/(1 - V_t/V_a)] \qquad \text{(equation 10)}$$

where $mg_c$ is the paper chip weight, pounds; $\rho$ is the ambient air density, pounds/ft$^3$ (0.075#/ft$^3$); lw is the chip rectangular area, ft$^2$; $V_a$ is the primary flow channel air flow speed, ft/sec; and $V_t$ is the paper chip velocity at any instant of time, ft/sec. The behavior of the paper chip under the above assumption again shows the criticality of generating the largest peak pressure (largest air velocity) as possible in the primary flow channel. Inspection of equation 8 demonstrates this since the time to accelerate the chip (that is, to remove it quickly from the cutting roller) gets less as the air flow velocity increases.

Velocity measurements taken on an air flow channel 18 inches in length and having widths of ½ inch and ¾ inch between a roller and a baffle having a curved edge by means of an air velocity meter, Model No. 443, manufactured by Kurz Instruments, Inc. The air stream was sucked through the channel by means of being connected to a 5-inch diameter round duct, connected in turn to the input side of a centrifugal fan, Cincinnati Fan Company Model No. PB 12A, rated at 1060 cubic feet per minute at 6 inches static pressure. Velocities of 8,500 and 7,500 feet per minute, respectively, were obtained, such velocities providing highly effective removal of chips.

While the invention is illustrated above with respect to a specific embodiment and explanations, it is not to be understood as so limited, but is limited only as indicated by the appended claims.

We claim:

1. Apparatus for removing scrap paper chips from a rotary cutter having a pair of opposing, horizontally disposed rollers carrying longitudinally extending knives arranged to come into slight contact with an opposing roller at a defined cutting region and thereby sever chips from a paper workpiece being conveyed between said roller comprising:

a plurality of impalement pins mounted on one of said rollers spaced apart from and in alignment with one of said knives and arranged to impale said chips upon being cut in said cutting region and to convey the impaled chips away from the cutting region;

a chute having an inner side member, with an upper edge thereof placed parallel to, slightly spaced apart from, and below the roller on which said pins are mounted, said chute including an outer side member and end members defining a passageway enclosed on sides of the passageway and open at a top and bottom thereof;

a baffle plate slidably mounted on the top of said chute and having a straight inner edge with a curved cross section across said plate at said edge and adapted to be placed a predetermined distance from said roller so as to define a low-pressure, high-velocity air flow channel therebetween, said baffle plate being disposed to enclose the open top end of said chute except for said flow channel;

means for propelling an air stream downward through channel; and means for communicating the outer end of said chute with said air propelling means, whereby said impaled chips may be stripped from said impalement pins by low-pressure, high-velocity air and conveyed through said chute.

2. Apparatus as defined in claim 1 wherein said roller on which said pins are mounted is a knife/anvil roller disposed below and in cooperating relation with a knife roller having a pair of knives mounted thereon.

3. Apparatus as defined in claim 1 wherein said inner edge of said baffle plate is located a distance of ⅜ inch to 1½ inches from said roller.

4. Apparatus as defined in claim 3 wherein said distance is ⅜ inch.

5. Apparatus as defined in claim 1 wherein said air propelling means is a centrifugal fan having its input side communicating with the bottom of said chute.

6. Apparatus as defined in claim 5 wherein said fan has an output side communicating with a duct for propelling said chips therethrough to disposal.

7. Apparatus as defined in claim 1 wherein said curved surface of said baffle edge is semicircular.

8. Apparatus as defined in claim 7 wherein a top edge of said outer side member is located substantially downward from the upper edge of said inner side member, and the baffle plate extends diagonally downward from said inner edge thereof.

9. Apparatus as defined in claim 1 wherein said curved surface of said baffle edge is elliptical.

10. Apparatus as defined in claim 1 wherein said curved surface of said baffle edge is parabolic.

11. Apparatus for removing scrap paper chips that are impaled on pins and are being carried away from a cutting area of a rotary cutter on a horizontally disposed roller comprising:

a generally rectangular chute located along a length of said roller and in a direction toward which the roller is rotating, said chute including an inner side member having an edge placed parallel to and slightly spaced apart from said roller, end members, and an outer side member defining a region enclosed on sides thereof by said side members and open at inner and outer ends of the region;

a baffle plate slidably mounted on said chute and having an inner edge with a curved cross section across said plate at said edge and adapted to be placed a predetermined distance from said roller so as to define an air flow channel therebetween, said baffle plate being disposed to enclose the open inner end of said chute except for said flow channel;

means for propelling an air stream through said flow said flow channel; and means for communicating the bottom of said chute with said air propelling means, whereby said chips may be stripped from said impalement pins by low-pressure, high-velocity air and conveyed through said chute.

12. Apparatus as defined in claim 11 wherein said difference is $\frac{3}{8}$ inch to $1\frac{1}{2}$ inches.

* * * * *